US005733068A

United States Patent [19]

Reinert, Sr.

[11] Patent Number: 5,733,068

[45] Date of Patent: Mar. 31, 1998

[54] METAL FOUNDATION PUSH-IT AND INSTALLATION APPARATUS AND METHOD

[76] Inventor: Gary L. Reinert, Sr., 4319 Middle Rd., Allison Park, Pa. 15101

[21] Appl. No.: 705,164

[22] Filed: Aug. 29, 1996

Related U.S. Application Data

[63] Continuation-in-part of Ser. No. 266,183, Jun. 27, 1994, Pat. No. 5,570,975.

[51] Int. Cl.[6] ..... E02D 7/00; E02D 17/02

[52] U.S. Cl. ..... 405/232; 173/184; 173/188; 175/171; 405/229

[58] Field of Search ..... 405/232, 229, 405/244, 231, 303, 245–247, 271; 175/162, 171, 19, 20, 170; 173/184, 186–188, 193, 24, 26, 28, 42, 44

[56] References Cited

U.S. PATENT DOCUMENTS

| | | | |
|---|---|---|---|
| 2,285,889 | 6/1942 | Blanchard . | |
| 3,621,910 | 11/1971 | Sanford | 175/171 X |
| 3,864,923 | 2/1975 | Turzillo | 405/232 |
| 3,869,003 | 3/1975 | Yamada et al. | 405/232 |
| 4,193,459 | 3/1980 | Engstrom | 405/245 X |
| 4,296,821 | 10/1981 | Larson | 175/171 X |
| 4,626,138 | 12/1986 | Boyes | 405/232 |
| 4,637,758 | 1/1987 | Tamaki et al. | 405/248 |
| 4,809,788 | 3/1989 | Nelson | 173/42 X |
| 4,813,496 | 3/1989 | Rohweller et al. | 175/171 X |
| 5,018,905 | 5/1991 | Kinder | 405/230 |
| 5,104,264 | 4/1992 | Castagner et al. | 405/232 X |
| 5,145,286 | 9/1992 | Summers | 405/258 |
| 5,232,268 | 8/1993 | Dengler et al. | 173/184 X |
| 5,269,107 | 12/1993 | Klemm | 52/115 |
| 5,544,978 | 8/1996 | Albers | 175/171 X |

FOREIGN PATENT DOCUMENTS

| | | | |
|---|---|---|---|
| B0363044 | 10/1981 | Austria . | |
| A0794556 | 2/1936 | France . | |
| A2534292 | 4/1984 | France . | |
| 0089527 | 7/1980 | Japan | 405/232 |
| 0223217 | 9/1988 | Japan | 405/232 |
| 0223218 | 9/1988 | Japan | 405/232 |
| 0146015 | 6/1989 | Japan | 405/232 |
| 0260117 | 10/1989 | Japan | 405/232 |
| 0767285 | 9/1980 | U.S.S.R. | 405/254 |
| 0861476 | 9/1982 | U.S.S.R. | 405/232 |
| A2060742 | 5/1981 | United Kingdom . | |
| WO-A 93 21393 | 10/1993 | WIPO . | |

*Primary Examiner*—Dennis L. Taylor
*Attorney, Agent, or Firm*—Douglas G. Glantz

[57] ABSTRACT

Mobile metal foundation installation apparatus and method are disclosed including a push-it carriage movably supported through controllable positioning to push a metal foundation into the ground by hydraulic cylinders pushing against a header frame held and secured in adjustable positions on a mobile tower. After the hydraulic cylinders extend to a maximum extension, the pushing reaction bar can be advanced to a lower position in the side frame of the tower. As the foundation is pushed into the ground, at least one vibrator on said push-it carriage is actuated for vibrating the cylindrical foundation body and longitudinal fins. An auger is aligned below the push-it carriage to drill in advance of pushing the metal foundation into the ground in one step. Outboard satellite anchors hold down the mobile tower when the foundation is pushed into the ground. A second auger mounted and detachable on a crane drills holes for the outboard satellite anchors. The second auger can swing laterally to dig a left or right side outboard or satellite anchor hole. An extensible satellite anchor augering guide and anchor structural support extends and retracts on both sides of the mobile tower.

20 Claims, 5 Drawing Sheets

METAL FOUNDATION PUSH-IT AND INSTALLATION APPARATUS AND METHOD

BACKGROUND OF THE INVENTION

This application is a continuation-in-part of prior U.S. patent application Ser. No. 08/266,183 filed Jun. 24, 1994 now U.S. Pat. No. 5,570,975 and prior co-pending U.S. patent application Ser. No. 08/682,636 filed Jul. 26, 1996.

FIELD OF THE INVENTION

The present invention relates to structural foundations including earth anchors for supporting airport and roadway signs, utility poles, communication towers, and the like and installation apparatus and methods for such structural foundations.

BACKGROUND

By conventional methods, a concrete foundation, also called a concrete pier or pad, is utilized for the installation of various types of structures, e.g., signs, high mast lighting and utility poles, communications towers, and the like. A concrete pad or pier is utilized for its mass to provide a structural foundation for supporting such structures.

These structures are attached to the concrete pier or pad by means of bolts or threaded anchors which are set to the required elevation in a rebar cage prior to pouring the concrete in forms.

In the installation of such a concrete pier or pad by the conventional method, site layout is performed, equipment is deployed, the site is excavated, the spoils are removed, and a stone sub-base sometimes is placed in the excavated hole. The work requires a backhoe, a truck, and equipment operators as well as the engineer and one or more laborers depending on the size of the job. Materials, such as the stone for the sub-base, are also required. In the case of some installations, e.g., in airport runway work, all construction debris and equipment must be removed from the work site by the end of each work day.

Then pouring forms are built, a rebar mat is installed, bolts or threaded anchors are attached to the rebar at the required elevation, and the concrete pad is poured. This work requires a carpenter, a laborer, and the material, i.e., concrete, forms, test equipment, bolts, and rebar mats. Again, in the case of airport runway work, all construction debris and equipment must be removed from the site at the end of the work day.

Next, the forms must be stripped, and back-filling around the foundation takes place. This work requires a backhoe, the operator, a carpenter, a laborer, and materials used to back-fill and seed the area.

The conventional method requires the concrete to cure for about seven (7) days. This concrete curing sometimes takes longer depending on the type of concrete used. If testings show the concrete not to comply with a specified strength within the first seven (7) days, then it is required to wait twenty-eight (28) days before any structure can be installed upon the concrete.

Bolts or threaded anchors are used for the installation of structures on the foundation. The structures are installed after the concrete has cured. Accordingly, several days are required to install the concrete foundation and to place the structures into operation.

In the case of airport runway work, on the eleventh day, the concrete pad is drilled to provide holes for the installation of the concrete anchors. These concrete anchors are utilized for the installation of the anchor bolts which will be used for installing the airport runway sign upon the foundation. The sign then is installed and energized at this time through work performed by electricians. Accordingly, eleven days have been required to install and illuminate the airport runway sign.

From the description of the conventional method of installation for a structure supported by a concrete foundation, some of the major drawbacks of the conventional installation method are apparent. These drawbacks include prolonged roadway area closure time in the case of a roadway sign, utility pole, or high mast lighting pole, prolonged runway and taxiway closure time in the case of airport signs, and lengthy installation times. These drawbacks further include increased labor costs, weather dependent operation, and an increased risk of debris falling on the roadway or aircraft traffic areas (in the case of airport installations) attributable to the many truck trips required. These drawbacks and others are eliminated or substantially reduced by installing a metal sign or utility pole foundation.

INTRODUCTION TO THE INVENTION

A metal foundation is structurally and geotechnically engineered to provide the equivalent of a concrete foundation for each specific application. The metal foundation is completely coated with hot dip galvanizing for corrosion protection. For further protection in extremely corrosive soils, the metal foundations can be supplied as hot dip galvanized with an additional overall bitu-plastic coating. The metal foundation typically can include, e.g., in one embodiment, a length of standard schedule 40 pipe column with a number of longitudinal fins continuously welded to the entire length and to which a steel plate has been continuously welded to the top.

The metal foundation is installed by a simple, yet revolutionary method. The metal foundations are pressed into the soil, and no excavation is required.

On the same day, utilizing the metal foundation and installation method, a roadway or airport sign or utility pole, high mast lighting pole, or communications tower foundation can be set into the soil. The metal foundation provides a top plate upon which the structure can be installed. The foundation's top plate is pre-drilled to accept the structure's mounting bolts. The foundation is installed in the first hours of the work day, while in the later hours of the same work day, the structure is installed, wired, and energized. The installation requirements call for installation equipment, the metal foundation, and a crew of two pile drivers and one operator during the first hours of the work day, and electricians and materials in the final hours of the same day.

The metal foundation and installation method allow the entire installation to be performed in only one day, with one trip to the structure installation site. In the amount of time required to install one concrete foundation by the traditional method for airport sign foundations, eleven conventional metal foundations can be installed. In addition, all eleven foundations would have been installed at a lower cost and with a greater level of safety. Airfield closure time can be dramatically reduced.

Moreover, the metal foundation can be reused. If it becomes necessary to relocate a structure, the metal foundation can be removed and reinstalled at the new location. This removal and reinstallation provides not only a significant cost savings, but it removes any hazard associated with abandoned concrete piers or pads.

Metal foundations are engineered for specific applications. Some of these applications include high mast lighting poles, traffic lights, roadway sign or utility poles, airport signs, commercial signs and billboards, power distribution and communications towers, retaining walls, and many others.

The design of metal foundations is based on engineering calculations backed by independent, registered professional engineers and by extensive testing. For the calculations of the structural capacities, each foundation can be designed to take into consideration the geotechnical characteristics of the soil into which it will be installed, i.e., soil density, shear strength, plasticity, moisture content, and grain size.

Each metal foundation can be designed to exceed the load requirements of the structure which will be installed upon it. These loads are in four basic modes including (1) overturning moment capacity, (2) torsional moment capacity, (2) compressive load capacity, and (4) uplift capacity. Deflection limits are also calculated where applicable.

Metal foundations typically include, e.g., by way of illustration, a length of schedule 40, A-53 carbon steel pipe, six inches or larger in diameter. Three or four longitudinal fins, e.g., fabricated from A-36 carbon steel plate of the required thickness, are continuously welded to the pipe. These longitudinal fins are positioned 120 degrees from each other in the case of three fins or 90 degrees in the case of four fins. A carbon steel plate of the required thickness is continuously welded at the top of the pipe column and to the top end of the fins and is drilled and tapped to accept the mounting plate of the structure to be supported by the foundation.

In the case of airport signs and depending on the overall length of the sign, two foundations may be required, and a second "sign plate" may be required also. The length and width of the second steel plate depends upon the length and width of the airport sign as measured at its base. In the case of more than one foundation, the "sign plate" is bolted to the top plate of each foundation. All structural dimensions are calculated on the basis of the loads to be supported by the foundation.

Prior to attaching the airport sign to the foundation, a plastic boot can be bolted onto the sign or utility pole plate. This plastic boot can be approximately six inches larger than the sign base, and it stands one and one half inches above grade. The boot is designed and installed to prevent damage, e.g., damage from mowers, to the sign.

The airport sign plate can be drilled and tapped to accept a PVC conduit adapter which is male threaded on one end where it attaches from the bottom to the sign plate and female, PVC to PVC, at the other end. This enables the attachment of a length of PVC conduit to connect the sign to a junction box. In the case of other structures, an opening is provided at the top of the foundation pipe column for a conduit bringing electrical wiring to penetrate inside the structure for actual wiring or electrical connections. These arrangements allow easy wiring for energizing the structure.

The installation of the metal foundation involves pushing the foundation into the soil. This pushing method typically uses an anchor as a reaction point. An anchor at the end of a rod is dropped to the bottom of a shaft augered into the ground. The anchor is pre-stressed by expanding its four radial plates against the soil while compressing it, all done by hydraulic force. The reaction point so established then is utilized for pushing the foundation into the ground by hydraulic forces.

After pushing the foundation into the soil to the desired elevation, in the case of an airport sign foundation, a PVC connector is threaded into the sign plate which can be factory drilled and tapped for that purpose. The airport sign plate then is bolted to the foundation top plate, and a plastic boot then is bolted to the sign or utility pole plate. The airport sign then can be installed on the foundation and the wire installed. The airport sign is then energized. All work can be performed and completed in one day.

In the case of all other types of structures after pushing the foundation into the soil, a conduit is inserted through a small opening at the top of the pipe column below its top plate. This conduit will be used to pull electrical wires through it so as to bring power to the structure to be mounted upon the foundation.

Representative metal foundations are shown in Sero et al. U.S. Pat. No. 4,974,997 and Collins U.S. Pat. No. 5,234,290. The Sero et al. patent and the Collins patent show hydraulically pushing a prefabricated longitudinally-finned cylindrical metal foundation into a pre-augered hole in the ground. The Sero et al. patent and the Collins patent use a central anchor as a reaction point against which the hydraulic cylinders work. Hydraulic cylinders pushing against an I-beam can be held down by outboard or satellite anchors.

Conventional metal foundation installation methods require a preliminary augering step, a separate crane to move the foundation into position and to move the hydraulic pushing mechanism into position, and a central anchor inside the foundation, which anchor generally is removed after the metal foundation is installed in the ground.

It has been found, in accordance with the present invention, that the current technology of metal foundation installation equipment and methods requires the development of a novel mobile (truck-mounted) metal foundation installation machine for installing prefabricated, longitudinally-finned, cylindrical metal foundations into the ground by pushing the metal foundations through pushing forces provided by such a novel mobile (truck-mounted) metal foundation installation machine.

U.S. Pat. No. 4,626,138 discloses a non-impacting pile driver mounted on a low-boy wheeled trailer having ground engaging means. A mast of a spaced apart pair of upright wide-flange I-beams is adapted to have guide rails for slidably guiding a hydraulic ram carriage. The carriage has a sturdy transverse header for receiving the upward reaction force of the hydraulic ram. A pile engaging element has a configuration depending on the type of pile to be driven. The carriage cooperates with a latch means which allows the ram to push the pile step by step. The latch means locks the carriage to the mast at each of a series of locations that are spaced apart vertically. Plunger-like latch members at each side of the carriage are each movable horizontally toward and from locking engagement with abutments on the mast. A double-acting hydraulic cylinder actuates movement for each latch member into the abutments on the mast which are preferably defined by annular collars having inside diameters to slidably receive the latch members.

U.S. Pat. No. 3,869,003 discloses an auger fitted in the hollow portion of a pile to excavate the ground beneath the pile while simultaneously forcing down the pile by a hydraulic pressure device. A tower or leader mast includes a pair of reaction receiving brackets provided vertically at suitable intervals. A pair of hydraulic cylinders push against a structure to push the pile downward, and stoppers engage the corresponding lower faces of the reaction-receiving brackets.

U.S. Pat. No. 5,145,286 discloses a vehicle mounted anchor installer and swinging truck mounted boom.

U.S. Pat. No. 4,637,758 shows developments in placing an auger inside a hollow pile and rotating the auger to excavate the earth in the leading end of the pile.

U.S. Pat. No. 5,018,905 discloses a mobile vehicle or truck mounted core drilling equipment including controls. The drill bit and pipe string used to drill the bore may be used as a piling.

Japanese 62-304868 discloses what appears to be a hydraulic pile pusher driver combined with earth boring and outboard earth anchoring means. Setting and penetrating the pile and excavation is disclosed as can be performed by the same apparatus, thereby permitting construction to be simplified.

Japanese 63-88557 discloses augering so that a hollow pile can be driven without discharging soil, and outboard anchors 52.

Japanese 53-162604 discloses a general combination with outboard anchoring means.

USSR 774418 discloses outboard anchors 5 on support girder 3.

USSR 767285 discloses piles 8 guided by sleeves 9.

When the metal foundation is pushed into the ground, fins on the foundation can encounter rocks as well as hard, compacted soils. The rocks and hard soils make it necessary to stop the installation operation. Sometimes corrective action can be taken including an operation employing satellite anchors. The satellite anchors prevent the entire back-end of the push-it and installation apparatus from lifting off the ground.

It is an object of the present invention to provide a novel mobile metal foundation push-it and installation apparatus and method.

It is an object of the present invention to provide a mobile metal foundation push-it and installation apparatus and method which facilitates foundation installation in rocks or hard soils.

It is a further object of the present invention to provide a mobile metal foundation push-it and installation apparatus and method which do not use or require a preliminary and separate augering step.

It is yet another object of the present invention to provide mobile metal foundation push-it and installation apparatus and method which do not use or require a separate crane.

It is yet another object of the present invention to provide mobile metal foundation push-it and installation apparatus and method which do not use or require all the numerous steps of moving the anchor and the foundation into position.

It is another object of the present invention to provide mobile metal foundation push-it and installation apparatus and method which do not use or require all the numerous steps of moving the anchor and the foundation into position or to move the hydraulic pushing mechanism into and out of position.

It is another object of the present invention to provide mobile metal foundation push-it and installation apparatus and method which do not use or require a central anchor inside the foundation.

It is another object of the present invention to provide mobile metal foundation push-it and installation apparatus and method which provide important advantages of efficiency and productivity for installing metal foundations inserted into the ground.

It is another object of the present invention to provide mobile metal foundation push-it and installation apparatus and method which provide important advantages of efficiency and productivity for installing metal foundations inserted into the ground and which facilitates foundation installation in rocks or hard soils.

These and other objects of the present invention will be described in the detailed description of the invention which follows. These and other objects of the present invention will become apparent to those skilled in the art from a careful review of the detailed description and from reference to the figures of the drawings.

SUMMARY OF THE INVENTION

The present invention provides mobile metal foundation installation apparatus and method including a mobile platform, a metal foundation holder mounted on the mobile platform, and a push-it carriage and vibrator movably supported on a tower on the mobile platform through controllable positioning to push the metal foundation holder such that hydraulic cylinders push against a header frame held and secured in adjustable side bar securing positions on the side frame of the tower. As the hydraulic cylinders extend to a maximum extension, the bar can be advanced to a lower position in the side frame of the tower. As the foundation is pushed into the ground, at least one vibrator on said push-it carriage is actuated for vibrating the cylindrical foundation body and longitudinal fins. An auger on the mobile platform and aligned below the push-it carriage drills a hole in the ground in advance of pushing the metal foundation into the ground in one step. Outboard satellite anchors hold down the mobile platform when the foundation is pushed into the ground. A second auger mounted and detachable on a crane on the mobile platform drills holes for the outboard satellite anchors. The second auger can swing laterally to dig a left or right side outboard or satellite anchor hole. An extensible satellite anchor augering guide and anchor structural support extends and retracts on both sides of the mobile platform.

BRIEF DESCRIPTION OF THE DRAWINGS

FIG. 3 also shows a shock absorbing device and a cut-away of a hydraulic cylinder.

DETAILED DESCRIPTION

The present invention includes a novel mobile, truck-mounted metal foundation push-it and installation machine for installing prefabricated, longitudinally-finned, cylindrical metal foundations into the ground by pushing the metal foundations through pushing forces provided by hydraulic cylinders mounted on the mobile, truck-mounted metal foundation push-it and installation machine.

The present invention includes apparatus and method for providing a novel metal foundation push-it and installation machine which includes a truck-mounted crane and a tower for holding a push-it carriage including metal foundation holder and auger. The novel machine and method of the present invention augers a hole and installs the metal foundation in one step as the push-it carriage is pushed toward the ground.

Hydraulic pushing cylinders push against a header frame held in adjustable side bar securing positions on the tower, i.e., the hydraulic cylinders push against a bar secured to each side frame of the tower. After the hydraulic cylinders extend to a maximum extension, the bar can be advanced to a lower position in the side frame of the tower, and the hydraulic cylinder assembly is lowered so that it can push against the bar in its lower position.

The present invention includes apparatus and method for providing a novel metal foundation push-it and installation machine which includes a truck-mounted second auger used to drill holes for outboard or satellite anchors to hold down the truck when the foundation is pushed into the ground. The second auger can swing laterally to dig a left or right side outboard or satellite anchor hole. A truck-mounted extensible satellite anchor augering guide and anchor structural support extends and retracts on both sides of the truck.

The present invention includes apparatus and method for providing a novel metal foundation push-it and installation machine and method which do not use or require a preliminary and separate augering step, a separate crane to move the foundation into position or to move the hydraulic pushing mechanism into position, or a central anchor inside the foundation.

The present invention in one aspect provides an apparatus and method for pushing into the ground a pipe-column-type foundation with or without longitudinal fins alongside the pipe column.

Figure 1:
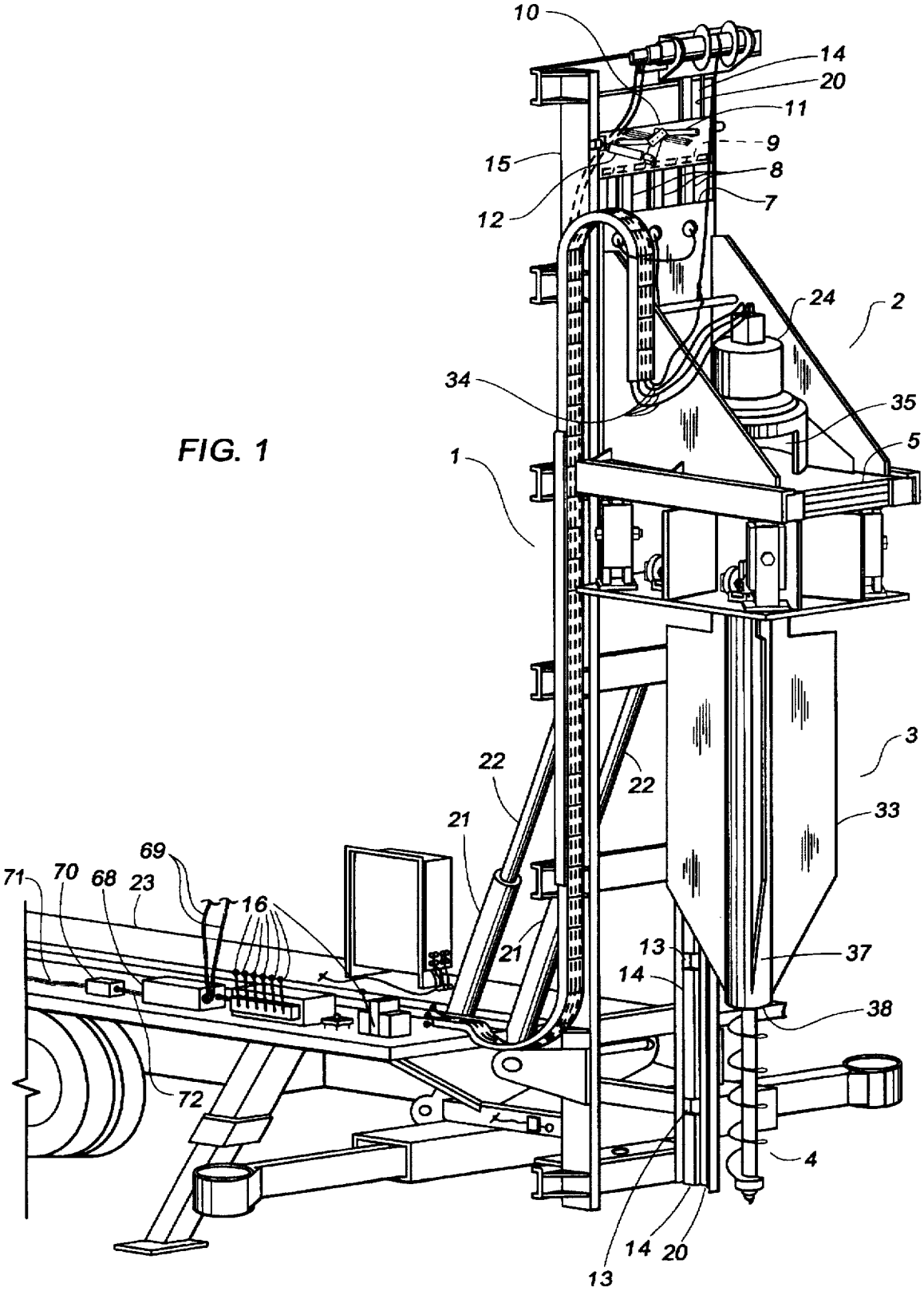
FIG. 1 is a partial perspective view of a metal foundation push-it and installation apparatus for installing a pipe foundation in the ground.

FIG. 1 shows the apparatus referred to as the metal foundation push-it and installation machine in a partial perspective view mounted on a truck. FIG. 1 shows a pivoting structural support tower in its operating position, its pivoting plate assembly, pivoting pin, and the tower's pair of hydraulic cylinders with their respective piston rods extended, in the tower raising mode. FIG. 1 shows a pushing/augering carriage with its reinforcement plates, its lower pushing plate, its sliding back-plate, its lifting bar, and a hydraulic motor for augering and the motor augering spoils outlet. Behind the sliding back-plate of the pushing/augering carriage are three partially extended piston rods from three respective hydraulic cylinders (not shown). A "locking dogs" mechanism is mounted on a plate frame with wheels on its front plate. An upper pushing plate is positioned behind a front plate. Vertical, thrust resistance bars on the tower's inside and cavities are created by the vertical bars such that a pair of locking dogs (bars) (not shown) can lock into the vertical bars. A winch has a cable and hydraulic motor for operating the winch.

FIG. 1 shows a finned pipe foundation with an auger inserted into its pipe column, both mounted on the carriage and a flexible power track containing several hydraulic fluid carrying hoses. Also shown are several operating control levers, two adjustably extendable truck uplift resistance assemblies and augering guides, one of four truck outriggers, a level on the truck bed, the container for transporting a remote operating control box, and several hydraulic fluid carrying hoses and connections.

Referring now to FIG. 1, metal foundation push-it and installation machine 1 is provided with pushing/augering carriage 2, which is utilized for pushing a pipe-column-type foundation 3 into the ground while concomitantly augering an earthen hole ahead of foundation bottom end 38 by means of auger 4. Foundation 3 can incorporate fins 33 along side pipe column 37. Foundation 3 also may be installed without fins 33. Auger 4 extends, e.g., by way of illustration, approximately two feet beyond bottom end 38. Carriage 2 having lower pushing-plate 5 pushes on foundation 3. Lower pushing-plate 5 receives its pushing force from a group of hydraulic cylinders, preferably three in number. Hydraulic cylinders are mounted on lower pushing plate 5 behind sliding back-plate 7. Sliding back-plate 7 is attached to lower pushing-plate 5 and is provided with wheels (not shown) which roll inside channel 20 of tower 15 on both sides to allow for a smooth up/down movement of carriage 2.

Continuing to refer to FIG. 1, piston rods 8 push upwardly against upper plate 9. Piston rods 8 are attached to upper plate 9 which is part of frame 10. Frame 10 is a rigid, box-like frame made of thick steel plates. Frame 10 houses a set of two locking dogs, i.e., locking steel bars (not shown). Locking dogs operating mechanism 11 operates the locking dogs (not shown) by means of hydraulic cylinder 12. Locking dogs mechanism 11 moves the locking dogs sideways into cavities 13 created by thrust resisting bars 14 which are vertically mounted on tower 15, i.e., structural frame 15. Such cavities 13 are spaced at equal intervals of approximately three feet on each side from the top of structural frame 15 down to its bottom. Such cavities 13 are the spaces created between each of two vertically adjacent thrust resisting bars 14. The locking dogs mechanism 11 is mounted on frame 10. An operator, by means of one of several control levers 16 or from a remote control box (not shown), actuates hydraulic cylinder 12 which operates the locking dogs mechanism 11.

Structural support tower 15 shown in the working mode, i.e., vertically, is provided with a pair of hydraulic cylinders 21 with piston rods 22 for collapsing tower 15 back onto truck bed 23 for transportation purposes. Raising or lowering tower 15 is performed by an operator using levers 16 or from a remote control box.

Operating the locking dogs mechanism by the operator refers to making hydraulic cylinder 12 force the locking dogs (locking bars) into cavities 13 on both sides of tower 15 so that piston rods 8 can push against upper plate 9. Piston rods 8 push against upper plate 9, which is part of frame 10, which in turn houses the locking bars (not shown). The upward thrust of hydraulic cylinders is effectively transferred by means of their piston rods 8 onto structural tower 15 by means of the tower's thrust resisting bars 14. These bars are approximately three feet in length and are installed vertically on both sides of the tower 15 at equal intervals from top to bottom, thereby leaving a space between each two cavities 13, i.e., vertically, at equal intervals on both sides of tower 15 from top to bottom. Thrust resistance bars 14 are firmly attached to tower 15, preferably by weldments.

By transferring the powerful, upwardly pushing force of hydraulic cylinders by means of their piston rods 8 onto tower 15 (which cannot move up or down), pushing/augering carriage 2 can slide downwardly on tower 15.

Pushing/augering carriage 2 will actually receive the resulting pushing force of hydraulic cylinders 6 because bottoms of hydraulic cylinders rest upon and are firmly attached to the back end of lower pushing plate 5.

The pushing force provided by hydraulic cylinders pushes foundation 3 into the ground.

Pushing/augering carriage 2 has hydraulic motor 24 mounted on the top surface of its lower pushing plate 5. Hydraulic motor 24 provides the power for augering an earthen hole by means of auger 4, ahead of the advance of bottom 38 of foundation 3, into the soil as foundation 3 is pushed downward into the ground by pushing/augering carriage 2.

Figure 2:
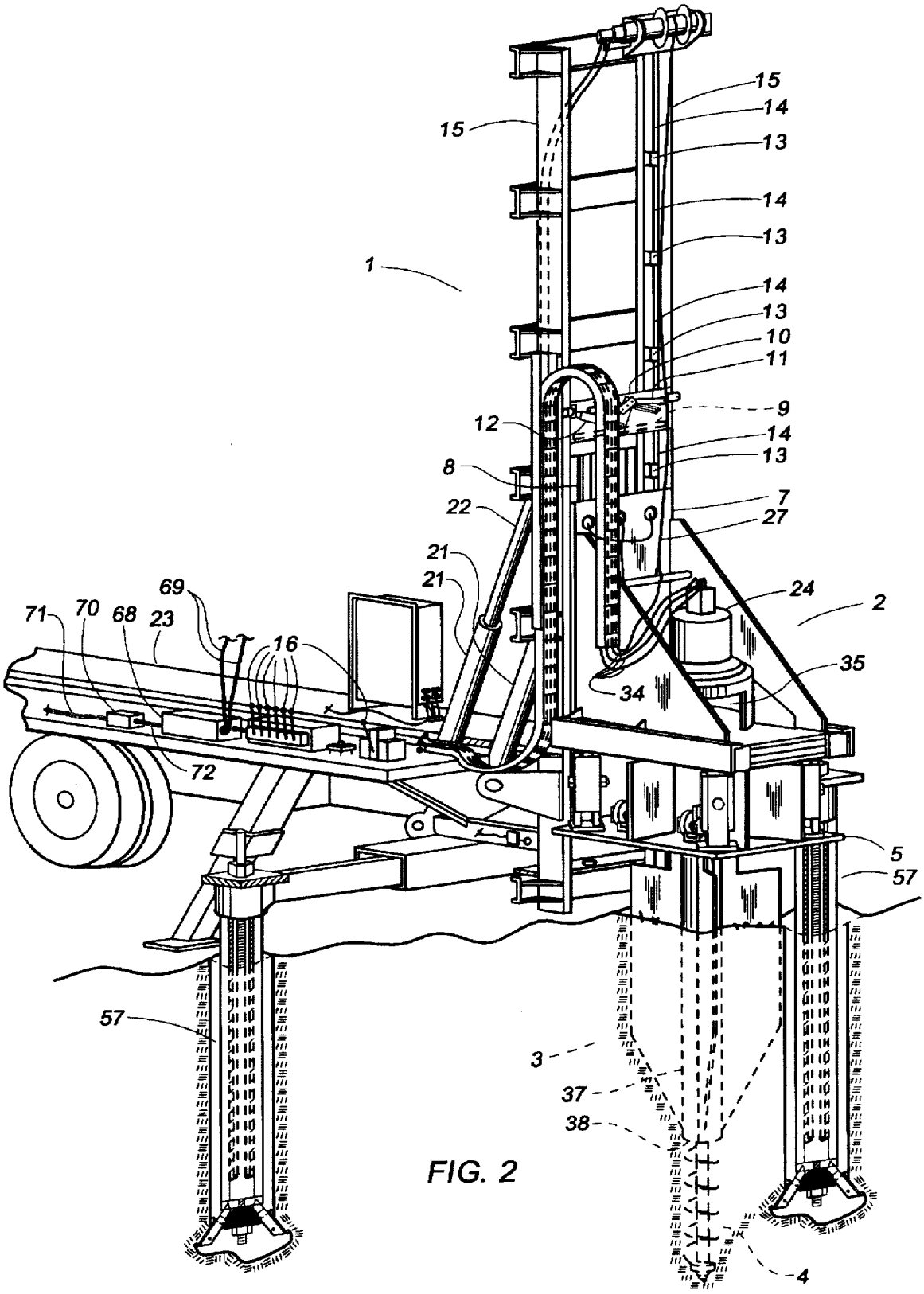
FIG. 2 is a perspective view of the metal foundation push-it and installation apparatus of FIG. 1, shown in the process of installing a finned-pipe foundation, also showing a cut-away of two satellite anchors.

During the installation process, i.e., when pushing a pipe foundation into the ground, fins 33, as shown in FIG. 1, can encounter rocks as well as hard, compacted soils. Referring now to FIG. 2, the hard soils make it necessary to stop the installation operation, in order to install satellite anchors 57, as shown in FIG. 2. The satellite anchors 57 prevent the entire back-end of the push-it and installation apparatus from lifting off the ground. The up-lifting created by the force applied by hydraulic cylinders 6, seen through a cut-away in FIG. 3, and pushing down on pushing-plate 5, as shown in FIG. 1, in turn pushes down on foundation 3 as auger 4 drills a hole ahead of end 38 of foundation 3, as shown in FIG. 2, during the process of pressing foundation 3 into the soil.

Figure 3:
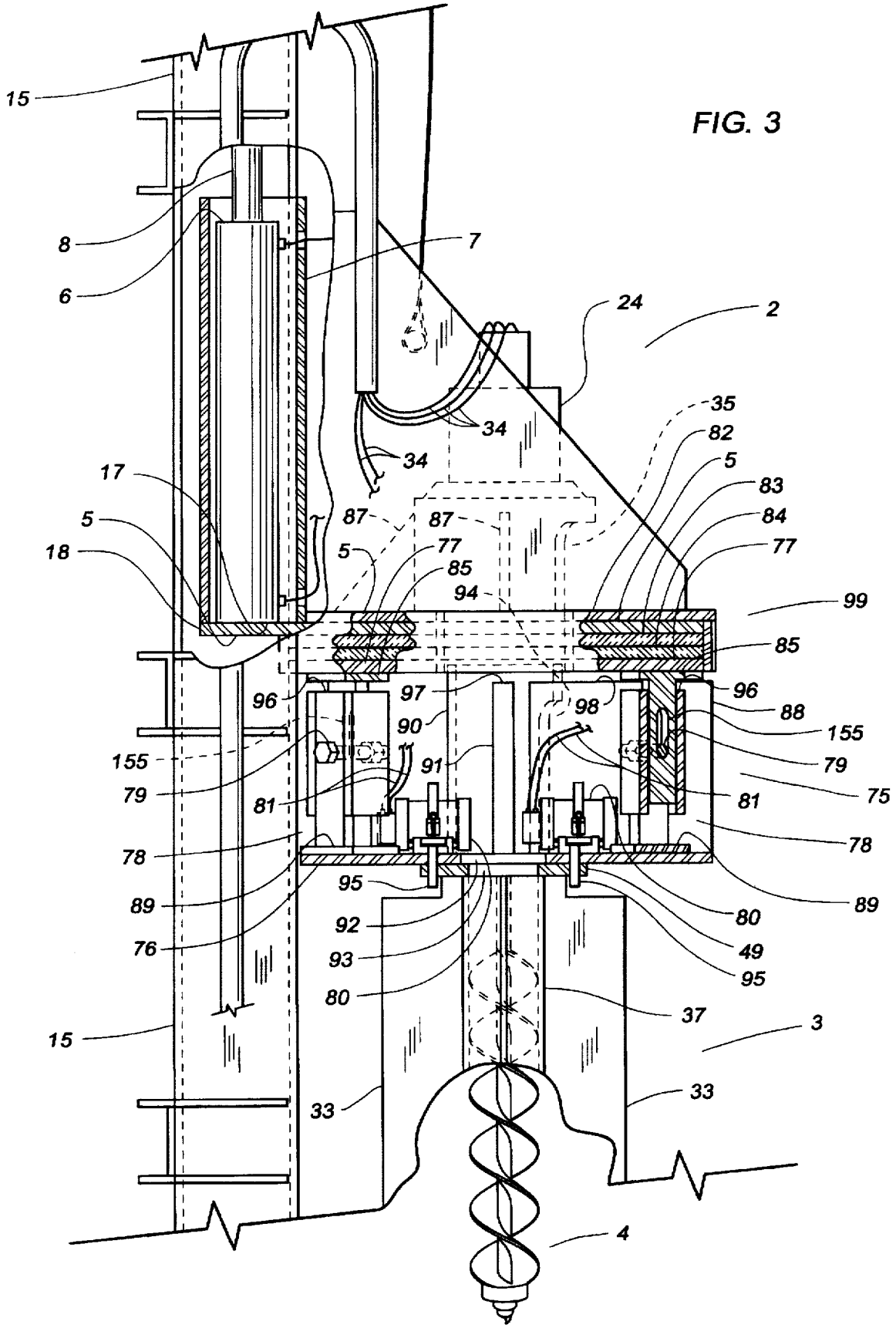
FIG. 3 is a side elevation view, partially in section, of a vibratory assembly in accordance with of the present invention shown installed on the pushing/augering carriage of the push-it and installation apparatus of FIG. 1.

The vibratory assembly 75 of the present invention, as shown in FIG. 3, substantially reduces and in many instances eliminates the requirement of installing satellite anchors 57, as shown in FIG. 2. In addition, when used in conjunction, i.e., in cooperation, with the satellite anchors 57, vibratory assembly 75 substantially reduces resistance to penetration of foundation 3 into the soil. Vibratory assembly 75 accelerates its foundation 3 installation into the ground. Whenever rocks are encountered by fins 33 of foundation 3, shock-type, axially-applied vibrations push aside or shatter the rocks. On hard compacted soils, the shock-type, axially-applied vibrations transferred to foundation 3 from vibratory system 75, as shown in FIG. 3, facilitate the penetration of fins 33 into the soil.

Pipe column 37 of foundation 3 is not affected by rocks or hard soils when being pushed into the soil because auger 4 drills an earthen hole ahead of the advancement of end 38 of pipe column 37.

Figure 4:
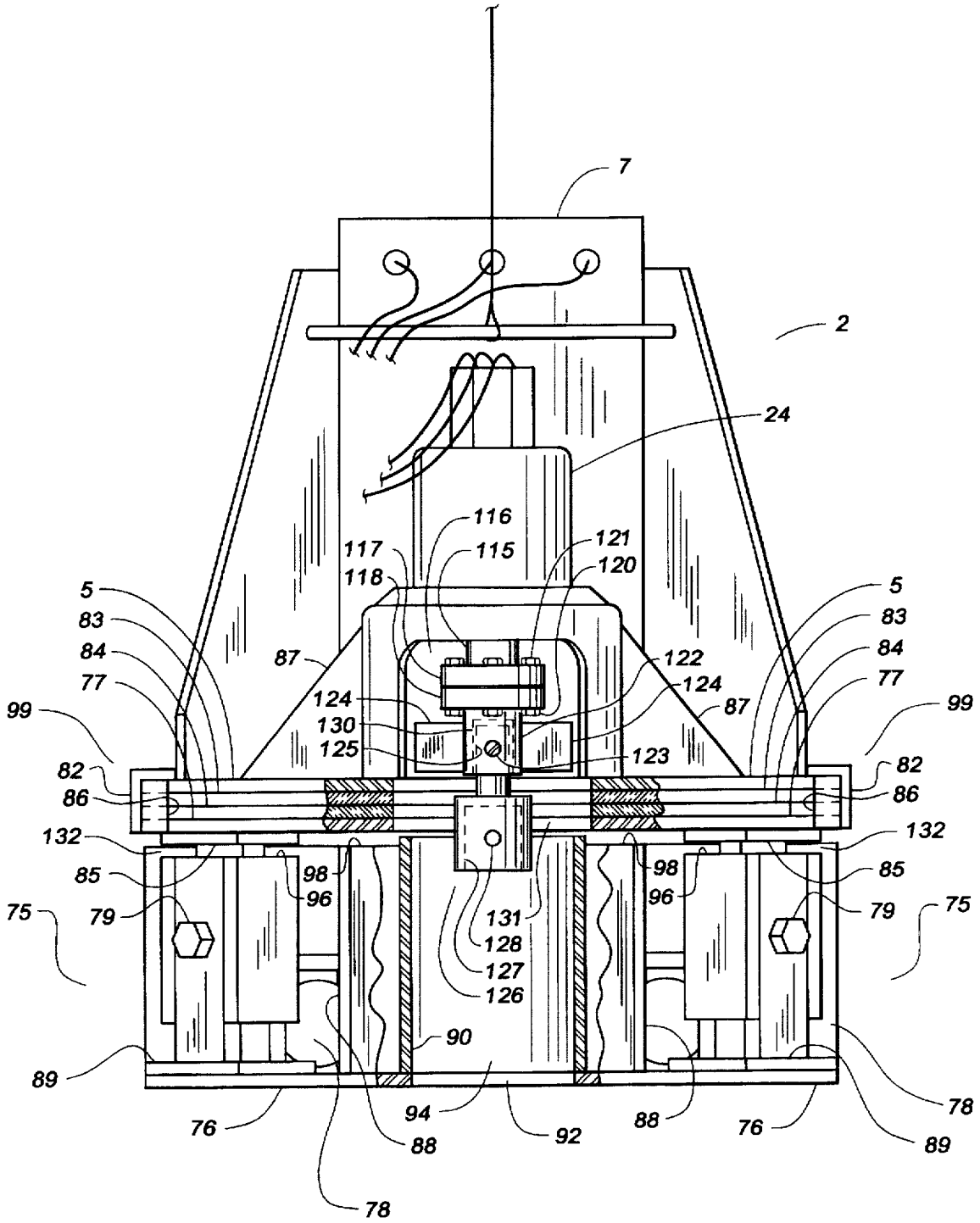
FIG. 4 is a front elevation view, partially in section, of the vibratory assembly and shock absorbing device in accordance with the present invention shown installed on the push-it machine of FIG. 1.
Figure 6:
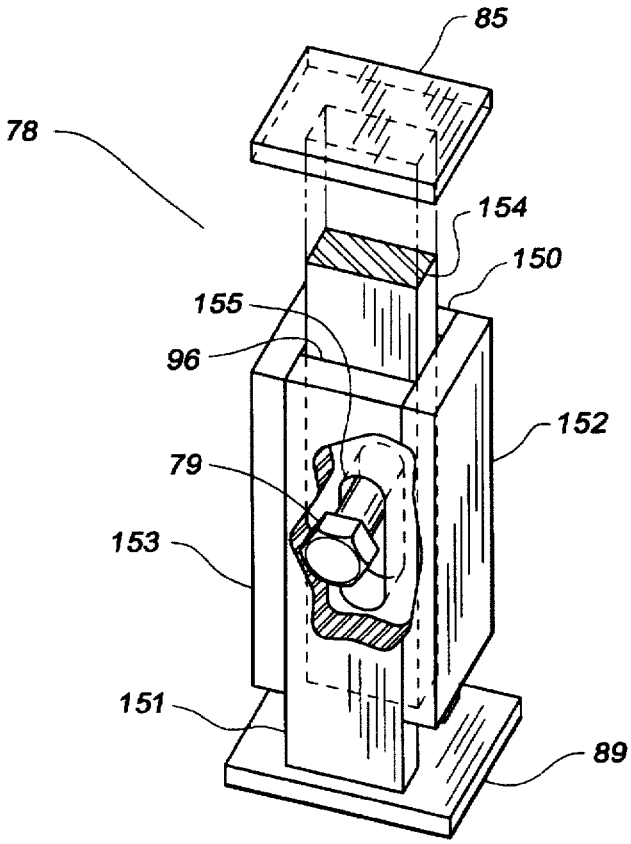
FIG. 6 is a perspective view of a vertical movement-guiding sliding-plates assembly component in accordance with the present invention, partially shown in FIGS. 3, 4, and 5.

Referring now to FIGS. 3 and 4, the vibratory assembly 75 of the present invention comprises vibratory steel plate 76, which has center opening 92 and which is suspended from steel plate 77 by means of four vertical movement-guiding sliding-plates assemblies 78, as shown in FIG. 6. Steel plate 77 is welded on bottom angle bar 82, (best shown on FIG. 4) of shock absorbing device 99. Angle bar 82 rests upon pushing plate 5 on two sides and is not welded, clamped, or bolted to plate 5. Top plate 85, as shown in FIGS. 3, 4, and 6, of vertical movement-guiding sliding-plate assemblies 78 are welded onto the underside of vibratory steel plate 77.

Figure 5:
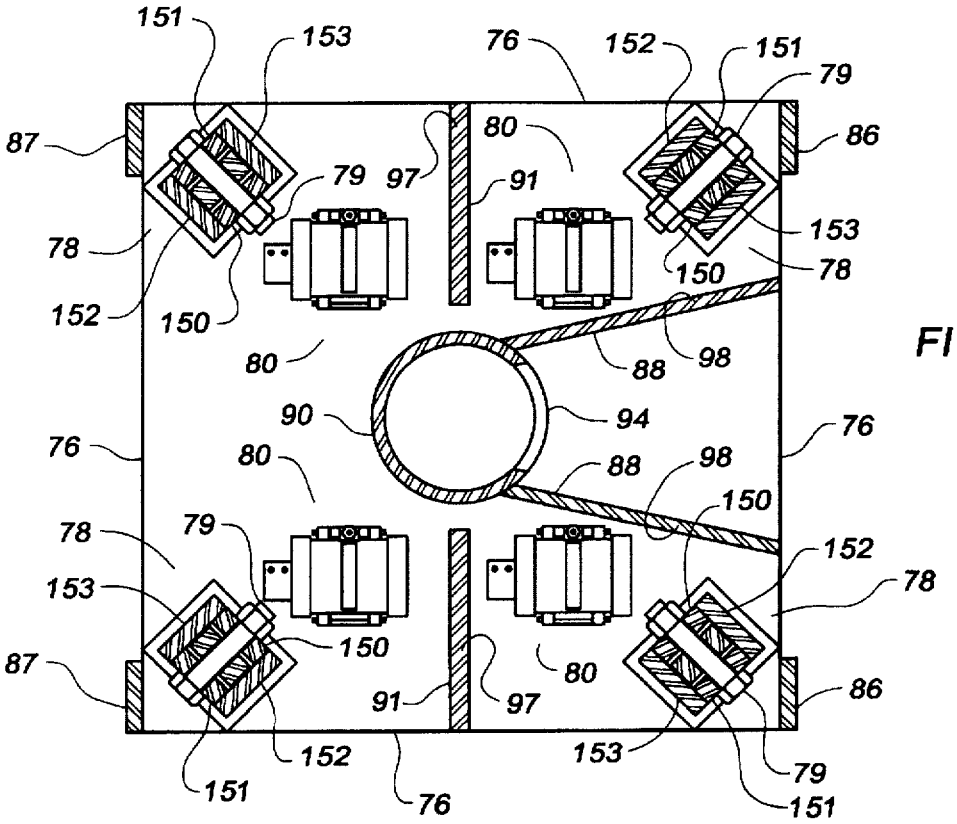
FIG. 5 is a plan view of the vibratory assembly of FIG. 3.

Linear, e.g., vertical, movement-guiding sliding-plates assemblies 78 can be seen in FIG. 5, a plan view of the vibratory assembly 75, and can be seen in perspective view, as shown in FIG. 6. At least one and, preferably, four hydraulic vibrators 80 are firmly mounted on vibratory steel plate 76, substantially equidistantly to the center point of vibratory steel plate 76. The center point of vibratory steel plate 76 is defined by the periphery of steel pipe 90, which is vertically mounted, e.g., by means of weldments, on vibratory plate 76. The inside of pipe 90 also defines opening 92 of plate 76. The entire vibratory assembly, with all its components, including shock absorbing device 99, could be slid in and out of pushing plate 5. Stoppers 86 in the front end of pushing plate 5 and stoppers 87 on its back end prevent assembly 75 from sliding. Stoppers 86 need to be removed should vibratory assembly 75 ever be required to be slid out of the push-it and installation apparatus.

Steel pipe 90 has opening 94 facing the front end of the push-it and installation machine, as seen in FIGS. 4 and 5. Plates 88, welded to vibratory plate 76 and to pipe 90, together with opening 94 of vertically mounted pipe 90, define a novel means for the exiting of the augering spoils (not shown) when auger 4, as shown in FIGS. 1 and 2, is in the drilling mode, i.e., drilling a vertical earthen hole ahead of end 38 of foundation 3. Such novel approach prevents the augering spoils from exiting from opening 35, as shown in FIG. 1, on hydraulic motor 24 mounted on pushing plate 5 of augering/pushing carriage 2 of the push-it and installation machine.

By the methods and means described in my co-pending U.S. patent application Ser. No. 08/266,183 filed Jun. 24, 1994 and co-pending U.S. patent application Ser. No. 08/682,636 filed Jul. 26, 1996, the augering spoils are forced upwardly and out of opening 35, which occasionally creates mechanical problems. Novel opening 94, as defined by opening 94 and plates 88, prevent the augering spoils reaching hydraulic motor 24. Any spoils getting that far up are constantly swept by novel rotating plates 124 and pushed downward and out through opening 94.

Hydraulic augering motor 24 has three reinforcing plates 87 welded to its bottom portion as well as to pushing plate 5.

Continuing to refer to FIGS. 3 and 4, shock absorbing device 99 comprises angle bar 82 welded to the entire length of the underside, bottom edge of plate 77. Angle bar 82 at its top rests on pushing-plate 5 of augering/pushing carriage 2, as shown in FIGS. 1, 2. Shock absorbing device 99 further comprises two layers, 83, 84, e.g., plates 83, 84 of medium hardness rubber, with surface areas equal to that of plate 77. Center opening 131 in plates 77, 83, 84 and pushing plate 5, allows auger adapter 126 to protrude through the plates. Rubber plates 83, 84 cannot slide out of shock absorbing device 99 because of front stoppers 86 and back stoppers 87 and further because of 2 additional stoppers (not shown) at the center of the assembly, one in the front and one in the back (not shown).

The purpose of rubber plates 83, 84 is to absorb any upward component of the vibrations produced by vibrators 80. Such novel shock absorbing feature substantially decreases the transmission of the upwardly directed shock to the augering/pushing carriage 2 and therefore to hydraulic motor 24 and to auger 4 because bolt 79 of sliding-plates assembly 78, as shown in FIG. 6 of vibratory assembly 75, slides up and down inside elongated hole 155 of plate 154 of assembly 78 and because of shock absorbing device 99. Nevertheless, both the upward and the downward shocks are substantially applied to the foundation through its top plate 49 which is firmly attached to vibratory plate 76 by means of four conventional, strong clamping devices 95 (only two shown), two on each side of plate 76.

Foundation 3 is strongly clamped onto vibratory assembly 75 and vibrates, i.e., moves up and down, at the same speed as vibratory assembly 75. The movement can be characterized as a hammering/shearing, up and down movement, with a short stroke length at a high speed. The vibration force is provided by the four hydraulically powered vibrators 80. Vibrators 80 are connected by means of hydraulic hoses 81 to the push-it machine's hydraulic pump (not shown) and to control levers 16, as shown in FIG. 1. The up and down hammering shocks are allowed by the fact vibratory assembly 75 hanging down from plate 77 by means of four vertical movement-guiding sliding-plates assembly 78. Plates 154, as shown in FIG. 6 of sliding-plates assembly 78 are welded to plates 85, which in turn are welded to the bottom side of plate 77. Such novel arrangement allows the entire vibratory assembly 75 to slide up and down on plates 154 because bolts 79 can slide up and down inside elongated holes 155 of plates 154.

Referring now to FIG. 4, a front elevation is presented, showing hydraulic motor 24 mounted on top of pushing plate 5 of augering/pushing carriage 2 by means of weldments. Reinforcing plates 87 are welded onto hydraulic motor 24 and onto pushing plate 5 on 3 sides, as shown in FIGS. 3 and 4.

Hydraulic hoses 34 connect hydraulic motor 24 to push-it machine hydraulic pump (not shown) and to hydraulic control levers 16, as shown in FIG. 1. Power shaft 115 in opening 116 of hydraulic motor 24 provides connecting flange 117 which attaches to flange 118 by means of bolts 121. Flange 118 has welded onto it female auger coupling 122. Rotating plates 124 are welded onto female auger coupling 122.

Female auger coupling 122 provides a coupling cavity 130 for inserting male end 125 of auger adapter 126. Auger adapter 126 is kept firmly connected to auger coupling 122 by means of pin 123.

Auger adapter 126 protrudes through opening 131 of shock absorber 99, as shown in FIGS. 3 and 4, and into the inside of pipe 90. Auger adapter 126 provides opening 127 and through-hole 128 for connecting to an auger kelli-bar (not shown) and therefore completing the connection of an auger, e.g., auger 4, as shown in FIGS. 1, 2, to hydraulic motor 24 for augering an earthen hole ahead of the bottom end 38 of foundation 3.

Referring now to FIG. 5, vibratory assembly 75 is shown in plan view. A central pipe 90 is welded onto vibratory plate 76 to serve as a guide for inserting auger 4, as shown in FIG. 1, to connect via auger adapter 126 onto auger female coupling 122 and to hydraulic motor 24 by means of power shaft 115 and connecting flanges 117, 118.

Four vertical movement-guiding sliding-plates assemblies 78 are also welded to vibratory plate 76 by means of their bottom, horizontal plates 89, as shown in FIG. 6. Sliding-plates assemblies 78 are welded on each of the four corners of plate 76, e.g., at ninety degrees to each other. Sliding-plates assemblies 78 are mounted substantially equidistantly to pipe 90.

Openings 94 on pipe 90 and plates 88 welded to pipe 90 and to plate 76 provide an exit for the augering spoils (not shown during augering an earthen hole ahead of foundation 3. Plates 91 welded to plate 76 are provided for reinforcement required for pushing down foundation 3. During the pushing down of foundation 3 into the ground, plate 77 closes gap 132, as shown in FIG. 4, and presses down on top 96 of each sliding-plate assembly 78. Plate 77 also pushes down on tops 97 and 98 of plates 91 and 88 respectively. No pushing force is exerted upon bolt 79, because of elongated hole 155 of plate 154, as shown in FIG. 6.

FIG. 6 represents, in perspective, a more detailed view of the vertical movement-guiding sliding-plates assembly 78. Sliding-plates assembly 78 comprises a novel arrangement for guiding the direction of the movements of the vibrations provided by hydraulic vibrators 80, so as to substantially prevent side-ways movements. Plate 154 has top plate 85 welded to it. Top plate 85 is welded to the bottom of plate 77. Plates 154 are provided with elongated openings 155, as seen through a cut-away in plate 151. Elongated hole 155 on plate 154 allows bolt 79 to pass through plate 154 while allowing the linear, e.g., up and down, hammer-like movements of vibratory system 75 because vibratory plate 76 of vibratory assembly 75 has welded onto each of its four corners, by means of plates 89, a box-like compartment of each sliding-plates assembly 78. Such box-like compartment of sliding-plates assembly 78 is comprised of plates 150, 151, 152, and 153. Each one of these plates is welded to another plate on each side, while plates 150, 151 are welded to plate 89. Plate 154 is contained within, but not restricted by, this box-like compartment created by plates 150, 151, 152, and 153.

Top plates 85 are utilized for attaching assemblies 78 to plate 77, as shown in FIGS. 3, 4, by weldments. Bottom plates 89 are welded to vibratory plate 76. Each box-like compartment, welded at its bottom plate to vibratory plate 76, moves up and down, i.e., slides up and down, on fixed, i.e., not movable, plates 154, which are welded onto plate 77 by means of plate 85.

The method of installing foundation 3 in the ground, utilizing push-it and installation machine 1, as shown in FIG. 1, is fully disclosed in my co-pending U.S. patent application Ser. No. 08/266,183 filed Jun. 24, 1994 and co-pending U.S. patent application Ser. No. 08/682,636 filed Jul. 26, 1996. In the process of installing foundation 3, as shown in FIGS. 1, 2 into the ground, auger 4 is first inserted through center opening 92 of vibratory plate 76 and through the inside of pipe 90 and into opening 127 of auger adapter 126 which protrudes through center opening 131 of shock absorber 99. Pivoting tower 15, as shown in FIGS. 1, 2 horizontally rests upon truck bed 23 and utilizes an onboard hydraulic lift (not shown). A pin (not shown) is inserted in hole 128 in order to secure auger 4 to auger adapter 126, which is attached to female auger coupling 122 by means of pin 123 and by means of flanges 117, 118, and through power shaft 115 finally connecting auger 4 to hydraulic motor 24.

When auger 4 is installed, foundation 3 is placed over it, through the inside 93 of pipe column 37, as shown in FIG. 3, by means of the onboard hydraulic lift (not shown) mounted on truck bed 23. Then foundation 3 is firmly secured onto vibratory plate 76 by means of at least four strong clamping devices 95, as shown in FIG. 3, which firmly clamp together foundation 3 by means of top plate 49, against vibratory plate 76 of vibratory assembly 75. Then tower 15 is raised back to a straight up position, i.e., to its working position by means of a pair of hydraulic cylinders 21, as shown in FIGS. 1 and 2.

Auger 4, which extends, e.g., by way of illustration, approximately two feet beyond bottom end 38 and which is powered by hydraulic motor 24 starts augering an earthen hole ahead of bottom end 38 of foundation 3. Concomitantly to the augering, foundation 3 is also pushed downward into the soil by pushing plate 5 of augering/pushing carriage 2. The pushing force required for pushing foundation 3 into the ground is provided by three hydraulic cylinders 6 (only one shown), as seen through a cut-away in FIG. 3, which cylinders 6 push upwardly by means of their pistons 8 against resistance plate 9 of locking dogs mechanism 10, as shown in FIGS. 1 and 2. Bottom 17, of hydraulic cylinders 6 transfers the pushing force to back-end 18 of pushing plate 5 and to foundation 3 by means of its top plate 49, which is firmly attached to pushing-plate 5 by means of four, strong clamping devices 95, as shown in FIG. 3.

During the above described process, the foundation being pushed into the ground can encounter rocks or hard soils which substantially slow down the installation process.

Sometimes the characteristics of the soil, e.g., hardness or presence of rocks, make it necessary to install satellite anchors 57, as shown in FIG. 2, in order to prevent the back end of truck bed 23 of push-it machine 1 from being uplifted because of the resistance of such soils to the penetration of foundation 3 into such soils.

The process of installation of satellite anchors 57 is fully disclosed in my co-pending U.S. patent application Ser. No. 08/266,183 filed Jun. 24, 1994 and co-pending U.S. patent application Ser. No. 08/682,636 filed Jul. 26, 1996.

The vibratory assembly 75 of the present invention, working in cooperation with the augering of an earthen hole ahead of end 38 of foundation 3, and the concomitant pushing on the foundations top plate 49, as shown in FIG. 3, provides the means for a quicker installation of foundation 3. In many cases, the need for installing satellite anchors 57 is eliminated, as shown in FIG. 2. When utilized in those occasions when satellite anchors 57 must be installed, vibratory assembly 75 provides a much quicker installation.

The operator (not shown) of push-it machine 1 knows when to turn-on hydraulic vibrator 80. The operator generally knows the characteristics of the soil before hand because it is standard industry practice to take soil tests. Therefore, for hard soils or soils with rocks, the operator could turn on the hydraulic vibrators as soon as he feels it is necessary, i.e., when he sees foundation 3 penetrating at a slower pace than normal or when penetration stops and the back end of truck bed 23 gives signs of uplifting. The operator could also decide to start running vibrators 80 as soon as the push-it machine starts pushing foundation 3 into the soil.

Soil conditions can vary within relatively close distances when installing several foundations, e.g., in a straight line or in a larger general area at a certain distance one from another even with soil tests are available. An entirely different set of soil characteristic could be found, and quite often, such is the case. The main problem with rocks in the soil, particularly in unexpected places, is that foundation 3, not only could be penetrating at a much slower pace, but also could be pushed-in out of level if the operator is not paying attention to the rate of penetration of the foundation into the soil. In such cases, an entire set of corrective actions must be taken to correct such situation, usually at great costs and loss of time.

Hard soils, on the other hand, slow down foundation penetration. In both cases of rocks or hard soils, satellite anchors 57 are required.

The use of the vibratory assembly of the present invention prevents such problems because the hammering-like shocks provided by the assembly break and/or push aside such rocks as are encountered in normal operations. In addition, the vibratory system substantially reduces the need to install satellite anchors 57, as shown in FIG. 2, in such cases of rocks and hard soils.

Referring to FIG. 3, when pivoting tower 15 is placed in its working position, i.e., uprightly, the vibratory assembly 75 hangs down from the bottom of plate 77, providing a small gap 132, as shown in FIG. 4, between plate 85 and top 96 of plates 150, 151, 152, and 153 of sliding-plates assembly 78.

As soon as end 38 of foundation 3, as shown in FIGS. 1 and 2, touches the ground, the pressure provided by hydraulic cylinders 8, pushing down on pushing-plate 5 of the augering/pushing carriage 2, closes gap 132. Such pushing pressure is transferred downward and applied to the tops 96 of plates 150, 151, 152, and 153 of sliding-plates assembly 78. Such pushing pressure is also applied to tops 97 and 98 of plates 91 and 88, respectively. All plates are substantially thick for the purpose of receiving substantial pressure forces without developing structural deformation.

Rotary hydraulic vibrators as manufactured by Cougar Industries, or similar, of the clamp-on type were utilized for the test of the present invention. Nevertheless, many other types and manufacturers can be effectively used.

When hydraulic vibrators 80 are turned on, auger 4 has already being turned on and has been augering an earthen hole, e.g., two feet ahead of end 38 of foundation 3 while foundation 3 is being pushed into the ground by hydraulic cylinders 8, as shown in FIG. 1. At the same time, hydraulic vibrators 80 in cooperation with linear, e.g., vertical movement-guiding, sliding-plates assembly 78 produce hammering-like shocks of short length but high speed, which have been demonstrated in practice to speed up the installation process in normal soils. They push aside and/or shatter, i.e., break, stones and facilitate foundation penetration through hard soils in a much quicker fashion.

The vibratory assembly of the present invention provides an automation feature that substantially reduces guess work on the part of the operator as to deciding when is the optimum time to turn-on, i.e., put to work, the vibratory system.

Pressure differential sensor/transmitter 70, as shown in FIG. 1, is connected to the hydraulic fluid circuit 71 and to the programmable logic controlled 68 by means of cables 72. Programmable logic controller 68 is connected to the hydraulic lines and to the electric circuits (not shown) by means of hydraulic hoses/electrical cables 69.

The automatic operation is very efficient. Anytime the foundation's penetration into the soil slows down, e.g., when the foundation encounters increased resistance to its penetration into the soil, that is, encounters rocks or hard soils, a hydraulic pressure increase occurs. Such pressure increase is detected by pressure differential sensor 71, which generates a signal that is automatically processed by programmable logic controller 68. Controller 68 turns on vibrators 80 and activates a sound alarm (not shown). In the event the penetration rate returns to normal, controller 68 turns off vibrators 80.

The automatic function described in accordance with the present invention can be overridden manually by the operator at any time for safety reasons.

It is important to understand that the foundation fins 33 are the ones that are mainly affected by rocks or hard soils, not the foundation pipe column 37. Column 37 has no difficulty in penetrating the soil because auger 4 drills an earthen hole ahead of the penetration of end 38 of pipe column 37.

It is also important to understand that auger 4 is substantially isolated from the up and down hammering shocks because the vibratory assembly slides up and down on plate 154 of sliding-plates assembly 78, as shown in FIG. 6, by means of its bolts 79, which are firmly bolted to plates 150 and 151.

Bolt 79 can move up and down on elongated hole 155 of plate 154 without hitting the bottom or the top of hole 155.

In one aspect, the novel shock absorption is provided by the two layers 83 and 84 of rubber sandwiched in-between pushing plate 5 of the augering/pushing carriage 2, as shown in FIG. 1, and by plate 77. Vibratory assembly 75 hangs down from plate 77 by means of plate 154 welded to plate 77. Elongated holes 155 allow the up and down hammering movements of the vibratory assembly and, consequently, the up and down hammering movements of fins 33 of foundation 3.

The only occasion bolt 79 rests on the bottom of elongated hole 155 is when augering/pushing carriage 2 is holding the foundation in a vertical position without pushing it against the ground, i.e., when the vibratory assembly is hanging down on plates 154.

It is also important to understand that the vibratory assembly of the present invention is very useful even when satellite anchors 57, as shown in FIG. 2, had to be utilized. The hammering-like shocks applied to the fins increase the efficiency of the machine. Larger foundations can be installed in much quicker installation time with more cost effectiveness. The hammering-like shocks transmitted to the foundation fins facilitate fin shearing through the soils and push aside or break rocks encountered on the way down by working concomitantly with the downward pushing force exerted upon the foundation by hydraulic cylinders 21.

The vibratory assembly of the present invention substantially improves installation efficiency in all cases, i.e., whether satellite anchors are required or not. It has been proven to reduce the number of cases when satellite anchors are required.

Thus it can be seen that the invention accomplishes all of its objectives.

The present invention includes a novel mobile, truck-mounted metal foundation push-it and installation machine for installing prefabricated, longitudinally-finned, cylindrical metal foundations into the ground by pushing the metal foundations through pushing forces provided by hydraulic cylinders mounted on the mobile, truck-mounted metal foundation push-it and installation machine.

The mobile truck-mounted machine can be a tractor trailer flatbed truck, e.g. in one embodiment, or can be a vehicle mounted on rails or tracks.

The present invention includes apparatus and method for providing a novel metal foundation push-it and installation machine which includes a truck-mounted crane and a tower for holding a push-it carriage including metal foundation holder and auger. The novel machine and method of the present invention augers a hole and installs the metal foundation in one step as the push-it carriage is pushed toward the ground.

Hydraulic pushing cylinders push against a bar held in adjustable bar securing positions on the tower, i.e., the hydraulic cylinders push against a bar secured to the side frame of the tower. After the hydraulic cylinders extend to a maximum extension, the bar can be advanced to a lower position in the side frame of the tower, and the hydraulic cylinder assembly is lowered so that it can push against the bar in its lower position.

The present invention includes apparatus and method for providing a novel metal foundation push-it and installation machine which includes a truck-mounted second auger used to drill holes for outboard or satellite anchors or auger anchors to hold down the truck when the foundation is pushed into the ground. The second auger can swing laterally to dig a left or right side outboard or satellite anchor hole. A truck-mounted extensible satellite anchor augering guide and anchor structural support extends and retracts on both sides of the truck.

The present invention includes apparatus and method for providing a novel metal foundation push-it and installation machine and method which do not use or require a preliminary and separate augering step, a separate crane to move the foundation into position or to move the hydraulic pushing mechanism into position, or a central anchor inside the foundation.

Although the invention has been illustrated by the preceding actual examples, it is not to be construed as being limited to the materials or procedures employed therein.

Whereas particular embodiments of the invention have been described in detail hereinabove, for purposes of illustration, it will be evident to those skilled in the art that numerous variations of the details may be made without departing from the invention as defined in the appended claims.

The apparatus and process of the present invention are not limited to the descriptions of specific embodiments presented hereinabove, but rather should be viewed in terms of the claims that follow and equivalents thereof. Further, while the invention has been described in conjunction with several such specific embodiments, it is to be understood that many alternatives, modifications, and variations will be apparent to those skilled in the art in light of the foregoing detailed descriptions. Accordingly, this invention is intended to embrace all such alternatives, modifications, and variations which fall within the spirit and scope of the appended claims.

What is claimed is:

1. A mobile pipe-column-type metal foundation installation apparatus, comprising:

(a.) a mobile platform;

(b.) a pipe-column-type metal foundation holder supported on said mobile platform, said metal foundation having a cylindrical pipe-column-type body and longitudinal fins welded vertically alongside said cylindrical pipe-column-type body;

(c.) a push-it carriage for pushing said cylindrical-pipe-column-type metal foundation holder;

(d.) a vibratory assembly having at least one vibrator for vibrating said cylindrical pipe-column-type body and longitudinal fins; and (e.) an auger aligned below said push-it carriage and inside said cylindrical pipe-column-type metal foundation for drilling a hole in the ground in advance of pushing said cylindrical pipe-column-type metal foundation from said metal foundation holder into the ground.

2. A mobile pipe-column-type metal foundation installation apparatus, as set forth in claim 1, further comprising linear movement guiding means for vibrating in one linear direction.

3. A mobile pipe-column-type metal foundation installation apparatus, as set forth in claim 1, further comprising a shock absorbing assembly.

4. A mobile pipe-column-type metal foundation installation apparatus, as set forth in claim 1, wherein said vibratory assembly comprises a vibratory plate and four hydraulic vibrators mounted on said vibratory plate.

5. A mobile pipe-column-type metal foundation installation apparatus, as set forth in claim 1, further comprising a soil removal assembly for removing soil from said auger away from said vibratory assembly.

6. A mobile pipe-column-type metal foundation installation apparatus, as set forth in claim 2, wherein said linear movement guiding means comprises a vertical movement-guiding assembly having four vertical movement-guiding sliding plates.

7. A mobile pipe-column-type metal foundation installation apparatus, as set forth in claim 3, wherein said shock absorbing assembly comprises at least two shock absorbing layers for dampening upward vibrations.

8. A mobile pipe-column-type metal foundation installation apparatus, as set forth in claim 4, wherein said vibratory plate comprises a vibratory plate having a center opening in cooperation with a soil removal assembly for removing soil from said auger away from said vibratory assembly.

9. A mobile pipe-column-type metal foundation installation apparatus, as set forth in claim 6, wherein said vibratory assembly comprises a vibratory plate and four hydraulic vibrators mounted on said vibratory plate in a position directly above said longitudinal fins welded vertically alongside said cylindrical pipe column-type body.

10. A mobile pipe-column-type metal foundation installation apparatus, as set forth in claim 7, wherein said shock absorbing layers are composed of hard rubber for dampening upward vibrations.

11. A method of installing a cylindrical pipe-column-type metal foundation in the ground, comprising:

(a.) holding a cylindrical pipe-column-type metal foundation on a mobile platform, said metal foundation having an integral top plate for mounting a sign, high mast lighting or utility pole, or communication tower on said cylindrical metal foundation and further having longitudinal fins welded vertically alongside said cylindrical pipe column;

(b.) drilling a hole in the ground directly below and inside said cylindrical pipe-column-type metal foundation and pushing said cylindrical pipe-column-type metal foundation into the ground, wherein said drilling and pushing are performed in one step; and (c.) vibrating said cylindrical pipe-column-type body and longitudinal fins.

12. A method of installing a cylindrical pipe-column-type metal foundation in the ground, as set forth in claim 11, further comprising guiding vibratory movement in one linear direction.

13. A method of installing a cylindrical pipe-column-type metal foundation in the ground, as set forth in claim 11, further comprising dampening upward vibrations.

14. A method of installing a cylindrical pipe-column-type metal foundation in the ground, as set forth in claim 11, further comprising directing soil discharge away from vibrators employed in said vibrating.

15. A method of installing a cylindrical pipe-column-type metal foundation in the ground, as set forth in claim 11, wherein said vibrating comprises vibrating said cylindrical pipe-column-type body and longitudinal fins by four vibrators located directly above said longitudinal fins.

16. A method of installing a cylindrical pipe-column-type metal foundation in the ground, as set forth in claim 12, wherein said linear direction is vertical.

17. A method of installing a cylindrical pipe-column-type metal foundation in the ground, as set forth in claim 15, wherein said vibrating said cylindrical pipe-column-type body and longitudinal fins by four vibrators located directly above said longitudinal fins comprises vibrating on a mobile platform.

18. A method of installing a cylindrical pipe-column-type metal foundation in the ground, as set forth in claim 15, wherein said vibrating said cylindrical pipe-column-type body and longitudinal fins by four vibrators located directly above said longitudinal fins comprises vibrating on a tractor trailer platform.

19. A method of installing a cylindrical pipe-column-type metal foundation in the ground, as set forth in claim 15, wherein said vibrating said cylindrical pipe-column-type body and longitudinal fins by four vibrators located directly above said longitudinal fins comprises vibrating on a tractor trailer flatbed platform and pivoting structural support tower mounted on said flatbed platform.

20. A mobile pipe-column-type metal foundation installation apparatus, comprising:

(a.) a mobile tractor trailer flatbed platform and pivoting structural support tower mounted on said flatbed platform;

(b.) a pipe-column-type metal foundation holder supported on said tower mounted on said mobile tractor trailer flatbed platform, wherein said metal foundation comprises a cylindrical pipe-column-type metal foundation having an integral top plate for mounting a sign, high mast lighting or utility pole, or communication tower and further comprises longitudinal fins welded vertically alongside said cylindrical pipe column, wherein said metal foundation holder further comprises means for holding and securing said metal foundation integral top plate;

(c.) at least one tower-raising hydraulic cylinder for raising and lowering said pivoting structural support tower from said mobile flatbed platform;

(d.) a crane mounted on said flatbed mobile platform for lifting said metal foundation and said auger for insertion into said metal foundation holder on said pivoting structural support tower when extended to a substantially vertical, raised metal foundation installing position;

(e.) a push-it carriage movably supported on said tower for providing controllably movable positioning to said cylindrical-pipe-column-type metal foundation holder on said tower;

(f.) means mounted on said mobile flatbed platform for pushing said metal foundation by at least one foundation installing hydraulic cylinder pushing against a bar held in adjustable bar securing positions on said tower, wherein said foundation installing hydraulic cylinder for pushing against said header frame bar is controllably adjustably held and secured to the side frame of said tower such that as said foundation installing hydraulic cylinder extends to a maximum extension, said header frame bar can be advanced to a lower position in the side frame of the tower;

(g.) means for vibrating said metal foundation comprising a vibratory plate and four hydraulic vibrators mounted on said vibratory plate in a position directly above said longitudinal fins welded vertically alongside said cylindrical pipe column;

(h.) an auger on said mobile flatbed platform and aligned below said push-it carriage and inside said cylindrical metal foundation for drilling a hole in the ground in one step in combination with pushing said metal foundation by said metal foundation holder into the ground;

(i.) vertical movement guiding means having four vertical movement-guiding sliding plates for vibrating in one linear direction;

(j.) a shock absorbing assembly having at least two shock absorbing layers for dampening upward vibrations; and (k.) a soil removal assembly for removing soil from said auger away from said vibratory assembly.

* * * * *